United States Patent [19]

Pax

[11] Patent Number: 4,766,881

[45] Date of Patent: Aug. 30, 1988

[54] RANGE HOOD DEVICE

[76] Inventor: Henry A. Pax, 3108 Auburn Cir., Jeffersontown, Ky. 40299

[21] Appl. No.: 50,853

[22] Filed: May 18, 1987

[51] Int. Cl.[4] ..... F24C 15/20

[52] U.S. Cl. ..... 126/299 R; 126/299 D; 312/248

[58] Field of Search ..... 126/299 R, 299 D, 37 R, 126/37 A, 37 B, 332, 334, 335, 337 R, 339, 21 R; 312/246–248, 278, 321

[56] References Cited

U.S. PATENT DOCUMENTS

| | | | |
|---|---|---|---|
| 3,464,749 | 9/1969 | Bishop | 312/248 |
| 3,477,420 | 11/1969 | Raulston et al. | 126/299 D |
| 3,485,544 | 12/1969 | Beckerman | 312/248 |
| 3,848,005 | 11/1974 | Harper | 312/248 |
| 4,285,557 | 8/1981 | Paladino | 312/246 |
| 4,485,928 | 12/1984 | Staashelm | 312/246 |

*Primary Examiner*—James C. Yeung

*Attorney, Agent, or Firm*—Edward M. Steutermann

[57] ABSTRACT

A hood device for use with a cooking range including an outer hood chamber, a central air opening for emission of gases emitted from the cooking range where at least one generally rectangular chamber is provided on one side of the center section and includes inwardly directed lip means on opposite sides of the area, with a hinge arrangement adjacent to one of the lip areas. A utensil holder is pivotally connected to the hinge arrangement adjacent to the lip area where the utensil holder has a generally planar back surface and where the hinge includes an arrangement to allow longitudinal (fore and aft) movement of the back panel so that the back panel can be swung upwardly into the retangular opening and can then be moved forward so that an edge of the back panel is located on the second lip to retain the utensil holder in a stored position and where the back panel can be moved aft in the opposite direction to allow the back panel and utensil holder to be lowered into an accessible position.

8 Claims, 1 Drawing Sheet

RANGE HOOD DEVICE

BACKGROUND OF THE INVENTION

The present invention relates, in general, to storage devices and more particularly relates to a new and useful arrangement to permit storage of utensils in an area approximate to a cooking range where the utensils are accessible and within easy reach.

In general, a cook utilizing a cooking stove needs various knives and utensils and from time to time it is necessary for the cook to move some distance away from the stove in order to secure utensils which were either forgotten or for which the use was not anticipated.

In many situations a cook stove is located on one side of the room and the storage area for utensils is located across the room or at best a few steps away.

In the process of preparing certain foods it is advantageous to have a variety of utensils within easy access for example, in the event of unforeseen occurrences.

The utensils could be, and sometimes are, held in a container adjacent to the stove which takes up space needed for cooking.

Most modern cooking stoves are equiped with hood arrangements of one kind or another located immediately over the cooking stove and the principal function of these hood arrangements is to provide light and provide means for emission of fumes or gases generated by the cooking process.

In general the hood arrangements are as wide as the stove and only a small portion of the hood arrangement is utilized for emission of fluids and/or the provision of light. The present invention comprehends an arrangement where the excess space available in a typical range hood is utilized to accommodate utensil storage. The present funtions of the hood, scavenging gaseous emissions and directing shielded light on the cooking area, would not be compromised in any way by the utensil and knife containers in either the stored or the extended positions. The devices would normally be extended during the cooking periods, which leaves the hoods functionally unaltered. No prior art arrangement is known which provides the advantageous arrangements provided by devices within the scope of the present invention.

SUMMARY OF THE INVENTION

The present invention provides a new, useful and novel arrangement to utilize space available in most range hoods in order to accommodate the storage of utensil devices and knives which are made readily accessible to a person utilizing a cooking stove.

The device incorporates the cooking utensils as an integral and accessable part of the cook stove, however one that is easily and quickly removable for cleaning or transporting to another area for use. It "childproofs" the utensil and sharp knives and facilitates the "childproofing" of the stove and also the securing of the stove use by unauthorized persons.

Within the scope of the present invention the utensil storage devices provided can be either retrofit into existing range hoods or can, preferably, be designed to be accommodated in new range hoods specifically intended to provide utensil and knife storage. Devices within the scope of the present invention do not greatly increase the cost of range hoods but greatly increase the utility of the hoods.

Specifically, devices within the scope of the present invention are provided to be located within a range hood in stored position and then released to an accessible position with utensils/knives being easily withdrawn, used and reinserted.

Additionally, in one adaptation within the scope of the present invention a second shelf means is also provided adjacent to a utensil holding device in order to provide additional shelf space in the cooking area. This additional shelf could be used to hold serving bowls or a utensil drip pan.

It is recognized that by use of the advantageous features of the present invention the convenience of a cooking area is greatly enhanced without significantly increasing the expense incurred.

The devices by there location in the range hood would be generally inaccessible to small children. Further, childproofing could be accomplished by making the opening of the holders more difficult (not unlike that presently used to childproof some medicine containers). A master control located on the hood in the secured area would childproof the entire stove.

Briefly, the present invention provides a hood device for use with a cooking range including an outer hood chamber, a central air opening for scavenging the gases emitted from the cooking range where at least one generally rectangular chamber is provided on one side of the center section and includes inwardly directed lip means on opposite sides of the area, with a hinge arrangement adjacent one of the lip areas. A utensil holder is pivotally connected to the hinge arrangement adjacent the lip area where the utensil holder has a generally planar back surface and where the hinge includes an arrangement to allow longitudinal movement of the back panel so that the back panel can be swung upwardly into the retangular opening and can then be moved longitudinally so that an edge of the back panel is located on the second lip to retain the utensil holder in a stored position and where the back panel can be moved longitudinally in the opposite direction to allow the back panel and utensil holder to be lowered into the accessible position.

While various arrangements within the scope of the present invention will occur to those skilled in the art upon reading the disclosure set forth hereinafter in the drawing included herein examples within the scope of the present invention are illustrated in the accompanying drawings and described hereinafter but such descriptions and drawings represented by way of example and not by way of limitation.

DETAIL DESCRIPTION OF THE DRAWINGS

In the examples in accordance with the present invention, shown in the Figures.

DETAILED DESCRIPTION OF THE DRAWINGS

Figures 1, 2, 3, 4, 5, 6:
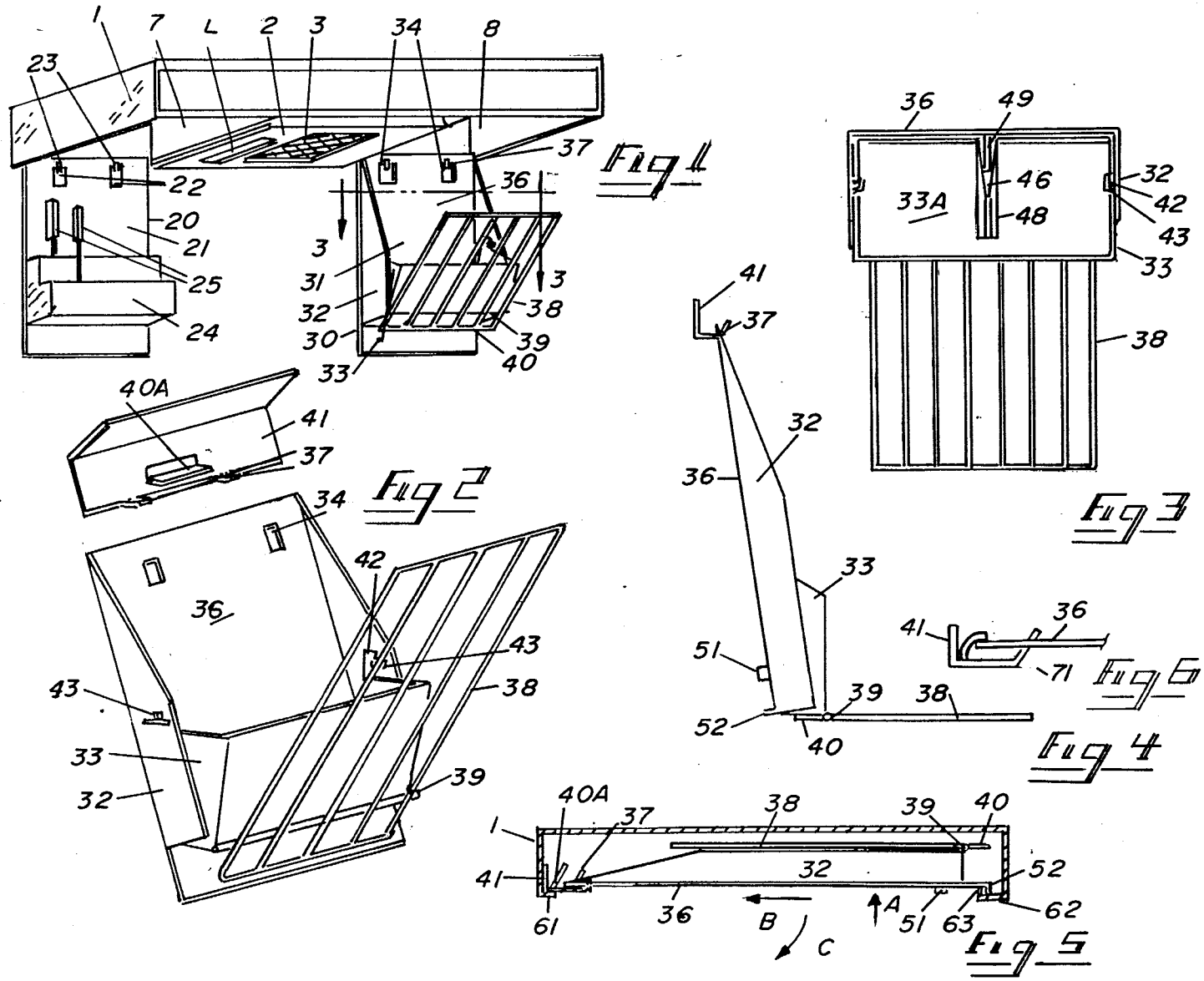
FIG. 1 is a prespective view of one example of an arrangement within the scope of the present invention.
FIG. 2 is an enlarged view of a utensil holder arrangement within the scope of the present invention.
FIG. 3 is a view taken along a plane passing through lines 3—3 of FIG. 1.
FIG. 4 is a side view of a utensil holder of the type shown in FIG. 2.
FIG. 5 is a cross sectional view of the utensil holding devices shown in the Figures in stored position.
FIG. 6 is a cross sectional view of another latching arrangement for devices within the scope of the present invention.

FIG. 1 is a perspective view of an example of a device within the scope of the present invention where a hood arrangement 1 is provided, as generally known in the art, to be located above a cooking range (not shown).

A central compartment 2 is provided having an inlet 3 to receive fumes or gases emitted from the cooking process occurring on the cooking range (not shown). A fan (also not shown) is typically included in the chamber 2 to induce flow of gases into the chamber for emission therefrom through an outlet also not shown but as is well known in the art.

In the arrangement shown chambers 7 and 8 are provided on either side of the central exhaust system 2 and a light source "L" can also be provided. As shown, utensil holders shown generally as 20 and 30 are provided to be disposed for retraction into the chambers 7 and 8 respectively.

Referring first to the utensil holder 20 a knife holder unit 24 is provided and carries a back plate 21 having elongate apertures 22 provided as shown to receive tabs 23 which, is described hereinafter, are provided by the hood arrangement to supply a pivot for movement of back plate 21.

A suitable utensil holder can be provide on each of the holders 20 and in the arrangment shown and as previously discussed knife holder 24 is provided on plate 21 of holder assembly 20 and adapted to receive knives 25 by means of slots in the holder 24.

Turning now to the holder 30, a bin 31 is provided and defined outer wall members 32 and pivotal wall members 33 as described hereinafter which tilts forward to accommodate the insertion of various cooking utensils as decribed hereinafter.

Elongate slots 34 are provided to allow longitudinal movement (fore and aft) of the back plate 36 where tabs 37 as described hereinafter are provided to receive the back plate 36 through the slots 34.

As shown a shelf 38 can be provided connected to the front edge of the bin 33 by means of a pivot 39 described hereinafter where an elongate stop extension 40 is provided to engage the underside of bin segment 32 in order to hold the shelf member outwardly as described hereinafter.

The utensil holder assembly 30 is shown in more detail in FIG. 2 illustrating a raised flange 40A on the bracket 41 aft of the tab 37. This requires the aft portion of the container to be raised before it can be moved horizontally aft sufficiently to clear the forward lip of the hood (see FIGS. 2 and 5). This feature, along with the location is for the purpose of child proofing the utensils such as knives (knives with sharp blades 4" or more in length are considered as lethal weapons) by making the utensils inaccessable to children.

Referring again to FIG. 2 which is an enlarged illustration of the utensil holder 30 to back plate 36 is shown with the lateral extensions 32 where the extensions are adapted to receive pivotable bin element 33. It will be understood that bin element 33 is pivoted to the side of the back plate 36 to allow forward movement of the bin element 33 when the back plate 36 is located in generally vertical position as shown in FIG. 1. Stop means are provided to limit the aft movement of the bin element 33 and in the illustrations the arrangement generaly include an upwardly extending tab 42, as shown where stops 43 are provided on either side of elements 32 by punching material inwardly to prevent forward movement of the bin element 33. Alternatively it will be understood that slots can be provided in the sides 32 with tabs carried by element 42 of bin 33 to extend through the slots.

The shelf 38 as shown, is connected by means of pivot 39 to the bin element 32 so that the shelf element 38 can pivot to a horizontal position when the back plate 36 has been pivoted to generally vertical position.

As previously described bracket 41 is provided to provided the tabs 37 which are received in the slots 34 to hold the device in pivotable position within the assembly.

FIG. 3 is an illustration of the device shown in FIG. 1 taken along a plane passing through the lines 3—3 of FIG. 1.

As shown the bottoms of 33A of the bin are provided with a fixed guide segment 46 extending inwardly from the back of element 36 to retain the bin 33 in position by means of the upstanding "V" element 48 carried by the bottom 33A of bin 33 so when the bin 33 is moved forward there would be no opening for handles to be caught.

The upstanding tabs 42 are shown as is the inturned lock mechanism 43 which receives the tabs 42 to hold the device within the element 32 but as previously described other arrangments can also be provided.

The shelf 38 is shown in generally extended horizontal relation. Additionally, a guide member 46 can be provided in the center of the bin element 33 as shown and a tab 49 can be provided extending inwardly from the back 36 to be receive within the sides of the guide 48 to both guide the movement of the bin element 33 and to likewise to provide additional stability to long handle utensils stored within the bin device so that the upper ends of the utensils do not extend unnecessarily outwardly over the edges of the sides 33.

FIG. 4 is very simply a cross sectional view the device in generally vertical position where the side elements 32 and bin element 33 are shown as is a handle 51 which can be located on the outer edge of the back plate 36 in order to accommodate the manipulation of the device. Also an outwardly extending lip 52 is provided to engage a safty lip rather within the hood as described hereinafter.

Referring now to FIG. 5, which shows a cross sectional view of the utensil holding elements in stored position the bracket 41 is shown in the back of the hood 1. An inturned lip 61 is provided the hood 1 as is adapted to receive the bracket 41 and can be secured to the hood so that the upper portion of the back plate 36 rests on the bracket 41 with the tabs 37 extending through the apertures 34 (not shown) in the back plate 36. The side element 32 is illustrated and will be noted that the bin element 33 is located completely within the side elements 32 and that the shelf 38 is located in a stored position on top of the device having pivoted there by means of pivot 39 with the support foot 40 extending outwardly over the end thereof. The lip 52 is shown, and as shown, the hood border 1 also includes interal lip 62 with an upturned elements 63 so that the lip 52 is retained on the lip 62 and within the lip 63 to prevent accidental removal of the utensil holder and also to add an element of safty because such an arrangement makes it more difficult for a child to remove the device.

In order to remove the device, first a movement shown by arrow A is required where handle 51 can be grasped, and the entire assembly moved upwardly. An aft movement is illustrated by arrow B is then required and a pivotable movement as illustrated by arrow C then occurs in order to place the element in the position shown in FIG. 4.

Tabs 37 are advantageously long enough to prevent release of the slots in horizontal position an are longer than tab 40A. Also tab 40A can be curved, as shown, so it cannot be cleared without moving the utensil holder forward.

FIG. 6 is an illustration of another arrangment where base 36 has a slot (not shown) and flange 71 prevents movement of the base without a first vertical movement.

It will be understood while the previous description has been with relation to the utensil holder, some arrangements are provided in connection with the knife holding arrangement 20 and that other equally usefuly utensil arrangement can also be provided so there is sufficient space above the utensil holder to store item like meat cleavers, large knives etc.

Also it will be understood that while the arrangment shown here encompases two utensil holding devices this is not meant to be by way of limination but more or fewer utensil arrangements can also be accommodated within the scope of the present invention.

It is also noted that the "childproofed" area above the utinsil holder could include a control, or master, switch, for the stove which would effectively "childproof" the entire stove thus, making dangerous utensils inaccessible to children contrary to most current situations where they are stored in easily accessible drawers or countertops. The securing mechanism could include a state of the art lock which would secure the stove from the use by any unauthorized persons and prevent access to the utensils especially the sharp instruments. It is noted also that the utensil/knife containers (as depicted) can be easily and quickly removed and replaced without any tools. The containers can be placed in the dishwasher or they can also be moved to summer camp or vacation home. The utensil holder could be hung on two nails and would not necessarily be placed in a hood. The containers could also be made adjustable so that they could be adjusted to fit a hood with slightly different dimensions. Additionally devices within the scope of the present invention can easily be adapted to retain a fire extinguisher in easy access to the cooking surface.

It will be understood that the foregoing are but examples of arrangements within the scope of the present invention not intended to be by way of limination and that various other arrangements also within the scope of the present invention will occur to those skilled in the art upon reading the disclosure set forth hereinbefore.

The invention claimed is:

1. Holding means in combination with a cooking range hood which includes a generally horizontally disposed outer frame to be located above a cooking range and a gas flow opening within said frame for emission of gases from said cooking range where at least one generally rectangular chamber is provided on one side of said frame and said chamber is downwardly open to define a utensil holder receiving opening means and inwardly directed lip means on opposite sides of said utensil holder opening means; a hinge means adjacent one of said lip areas; a utensil holder pivotally connected to said hinge means adjacent said lip area where said utensil holder has a generally planar base to allow said base to be pivoted from a position within said chamber to position extending downwardly therefrom and wherein said hinge allows longitudinal movement of said base panel so that said base can be swung upwardly into said utensil holder rectangular opening and can than be moved longitudinally so that one edge of the base is located on the second lip to retain said base in stored position and where said base can be moved longitudinally in the opposite direction to allow said base to be lowered into said accessible position.

2. The invention of claim 1 wherein said base means includes utensil holder means located on one side of said base means so that when said base means is moved to said stored positions said utensil holder means is located within said generally rectangular chamber.

3. The invention of claim 2 wherein said utensil holder means includes knife holder means having slots adapted to receive knife means so that the longitudinal axis of said knife means in generally parallel to the the longitudinal axis of said base means.

4. The invention of claim 3 wherein said shelf means is pivotally connected to the bottom of said utensil holder means to pivot to said generally horizonal position when said base means in said vertical position and wherein said shelf means includes extension means adapted to engage the bottom of said utensil holder means when said base means in said vertical position to hold said shelf means in said horizonal position.

5. The invention of claim 4 including interlock means to secure said utensil holder in said horizontally disposed position wherein said utensil holder must be moved in a first direction to release it from said securing means before it can be moved to said vertical position.

6. The invention of claim 5 including lock means to hold said utensil holder in said horizontal position.

7. The invention of claim 2 wherein said hinge means is pivotally connected to said base to be stored in generally parallel relation with said base means when said base means in located within said rectangular chamber and to extend in a generally horizonal position when said base means is in said generally vertical position and including stop means to retain said utensil holder means in said generally horizonal position when said base is in said vertical position.

8. Holding means in combination with a cooking range hood which includes a generally horizontally disposed outer frame to be located above a cooking range and a gas flow opening within said frame for emission of gases from said cooking range where at least one generally rectangular chamber is provided on one side of said frame and said chamber is downwardly open to define a utensil holder receiving opening means and inwardly directed lip means on opposite sides of said utensil holder opening means; a hinge means adjacent one of said lip areas; a utensil holder pivotally connected to said hinge means adjacent said lip area where said utensil holder has a generally planar base to allow said base to be pivoted from a position within said chamber to position extending downwardly therefrom where said utensil means includes a bin storage means having first and second bin elements wherein said first bin element is attached to said base means to be received within said rectangular chamber when said base means is moved to said storage position, second bin means adapted to be received within to be laterally and longitudinal moveable within said first bin means having guide means to guide said second bin within said first bin where said second bin element moves outwardly from said first bin element when said base means is in generally vertical position.

* * * * *